US005275106A

United States Patent [19]

Cutting et al.

[11] Patent Number: 5,275,106

[45] Date of Patent: Jan. 4, 1994

[54] INSENSITIVE FUZE TRAIN FOR HIGH EXPLOSIVES

[75] Inventors: Jack L. Cutting; Ronald S. Lee; William G. Von Holle, all of Livermore, Calif.

[73] Assignee: The United States of America as represented by the United States Department of Energy, Washington, D.C.

[21] Appl. No.: 23,167

[22] Filed: Feb. 19, 1993

Related U.S. Application Data

[63] Continuation of Ser. No. 897,149, Jun. 11, 1992, abandoned.

[51] Int. Cl.[5] ..... F42B 3/12

[52] U.S. Cl. ..... 102/202.7; 102/202.140

[58] Field of Search ..... 102/202.5, 202.7, 202.8, 102/202.9, 202.13, 202.14

[56] References Cited

U.S. PATENT DOCUMENTS

| | | | |
|---|---|---|---|
| 3,062,143 | 11/1962 | Savitt et al. | 102/202.5 |
| 4,316,412 | 2/1982 | Dinegar et al. | 102/202.5 |
| 4,602,565 | 7/1986 | MacDonald et al. | 102/202.7 |
| 4,729,315 | 3/1988 | Proffit et al. | 102/202.9 |
| 4,788,913 | 12/1988 | Stroud et al. | 102/202.5 |
| 4,907,509 | 3/1990 | Lieberman | 102/202.1 |
| 4,928,595 | 5/1990 | Weingart | 102/202.7 |
| 4,959,011 | 9/1990 | Nilsson | 431/263 |
| 5,052,301 | 10/1991 | Walker | 102/202.7 |
| 5,080,016 | 1/1992 | Osher | 102/202.7 |

FOREIGN PATENT DOCUMENTS

| | | | |
|---|---|---|---|
| 2213322 | 8/1989 | United Kingdom | 102/202.5 |

OTHER PUBLICATIONS

John R. Stroud, "A New King of Detonator-The Slapper", Preprint UCRL-77639, Feb. 27, 1976.

*Primary Examiner*—Stephen M. Johnson

*Attorney, Agent, or Firm*—Henry P. Sartorio; Roger S. Gaither; William R. Moser

[57] ABSTRACT

A generic insensitive fuze train to initiate insensitive high explosives, such as PBXW-124. The insensitive fuze train uses a slapper foil to initiate sub-gram quantities of an explosive, such as HNS-IV or PETN. This small amount of explosive drives a larger metal slapper onto a booster charge of an insensitive explosive, such as UF-TATB. The booster charge initiates a larger charge of an explosive, such as LX-17, which in turn, initiates the insensitive high explosive, such as PBXW-124.

17 Claims, 2 Drawing Sheets

INSENSITIVE FUZE TRAIN FOR HIGH EXPLOSIVES

The U.S. Government has rights in this invention pursuant to Contract No. W-7405-ENG-48 between the U.S. Department of Energy and the University of California for the operation of Lawrence Livermore National Laboratory.

This is a continuation of application Ser. No. 07/897,149 filed Jun. 11, 1992, now abandoned.

BACKGROUND OF THE INVENTION

The invention relates to fuzes for high explosives, particularly to fuzes for insensitive high explosives, and more particularly to an insensitive fuze train for high explosives.

Over the years various approaches have been made for safely igniting a high explosive charge. When employing explosives for the purpose of excavation, strip mining, and related earth moving activities, it has been a common practice to use blasting caps having electrical initiators, such as exemplified by U.S. Pat. No. 5,052,301 issued Oct. 1, 1991 to Richard E. Walker.

In various types of military ordinance and in a great many applications of high explosives in the civil sector, there has been a continuing effort to develop safe, reliable detonators which can be routinely activated by small amounts of electrical energy, such as exemplified by U.S. Pat. No. 4,316,412 issued Feb. 23, 1982 to Robert H. Dinegar et al. and U.S. Pat. No. 4,907,509 issued Mar. 13, 1990 to Morton L. Lieberman.

Another approach to the need for effective detonators for various types of explosive application was the thin film bridge detonator wherein a primer is placed on a thin film bridge and when sufficient current passes through the bridge its inherent resistance heating will fire or detonate the primer, which in turn will detonate the primary charge. These prior thin film bridge detonators are exemplified by U.S. Pat. No. 4,729,315 issued Mar. 8,1988 to Robert L. Proffit et al.

A different approach to detonation of high explosives is known as the "slapper detonator", as described in a Lawrence Livermore National Laboratory document, UCRL-77639 by John R. Stroud, entitled "A New Kind Of Detonator—The Slapper", dated Feb. 27, 1976, which operates by exploding a thin metal foil that accelerates a plastic film or flyer across a gap to impact on a high-density secondary explosive, which in turn initiates a main charge explosive. More recent detonators utilizing the "slapper" approach are exemplified by U.S. Pat. No. 4,928,595, issued May 29, 1990 to Richard C. Weingart and U.S. Pat. No. 5,080,016 issued Jan. 14, 1992 to John E. Osher.

The U.S. Department of Defense is currently interested in reducing weapon vulnerability and improving weapon safety in extreme and abnormal environments. Insensitive munitions are one way to achieve these goals. High explosive (HE) weapon fills in insensitive munitions have large failure diameters, and they are difficult to initiate intentionally. Thus, a fuze train is needed that will ignite these insensitive munitions at extremes of temperature, but will not compromise the insensitivity of the HE main charge fill to external threats.

SUMMARY OF THE INVENTION

It is therefore an object of the present invention to provide a detonating means for insensitive high explosives.

It is a further object of this invention to provide a fuze train for insensitive high explosives.

It is a further object of this invention to provide an insensitive fuze train for high explosives.

It is a still further object of this invention to provide an insensitive fuze train capable of initiating insensitive munitions at extreme temperatures.

It is another object of this invention to provide an insensitive fuze train for igniting an insensitive high explosive without compromising the insensitivity of the high explosive in abnormal thermal environments.

It is another object of this invention to provide an insensitive fuze train utilizing the "slapper" approach.

It is another object of this invention to provide an explosively driven slapper.

It is another object of this invention to provide an insensitive fuze train using the "slapper" concept for initiating the high explosive fills for bombs and shells without impacting sensitivity of the munitions.

Other objects and advantages of the present invention will become apparent from the following description and accompanying drawings.

Basically, the invention involves an insensitive fuze train to initiate insensitive high explosives using a slapper foil to initiate sub-gram quantities of a first explosive which in turn drives a larger metal slapper onto a booster charge of an insensitive explosive igniting same, which in turn ignites a larger charge of an explosive, which in turn initiates the main insensitive high explosive. More specifically, the fuze train comprises an electrical slapper assembly, a sub-gram initiating explosive pellet, a secondary slapper assembly, a UF-TATB booster change, and an LX-17 output charge.

BRIEF DESCRIPTION OF THE DRAWINGS

The accompanying drawings, which are incorporated into and form a part of the specification, illustrate an embodiment of the invention and, together with the description, serve to explain the principles of the invention.

DETAILED DESCRIPTION OF THE INVENTION

The present invention is directed to a fuze train for detonation of an insensitive high explosive (HE) charge, and more particularly to an insensitive fuse train which utilizes the slapper detonator approach to initiate various stages of the train. More specifically, the present invention involves an insensitive fuze train involving, for example, an electrically initiated slapper foil assembly having a bridge therein to initiate sub-gram quantities of HNS-IV or PETN explosive which drives a larger slapper onto a booster charge of insensitive UF-TATB explosive, which initiates a larger output charge of insensitive LX-17, which in turn, initiates a larger charge of LX-17 or a PBXW-124 main charge.

While specific examples of explosive materials, sizes, and configurations are described and shown to illustrate the principles of the present invention, it is not intended to limit the invention to these specific materials or embodiments, since other materials, sizes, shapes, quantities may be effectively utilized in carrying out the invention.

Figure 1:
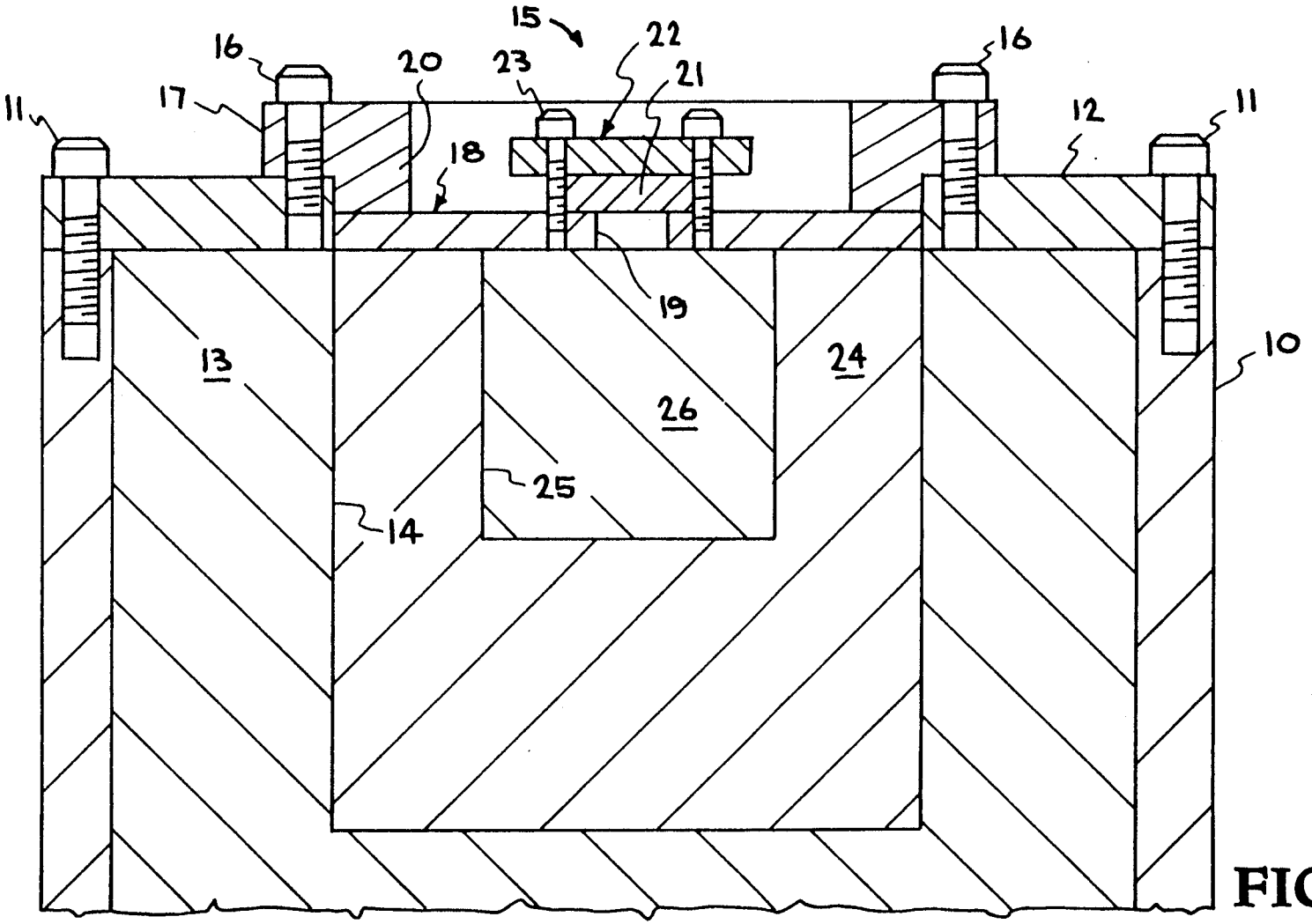
FIG. 1 illustrates in cross an embodiment of the fuse train of the invention mounted in an explosive to be detonated thereby.

Referring now to the drawings, the embodiment of the invention illustrated in FIG. 1 involves a test configuration conducted to determine if 4.00 inch by 4.00 inch LX-17 output charge of the insensitive fuze train of the present invention would properly initiate an insensitive main charge of HE, such as PBXW-124.

Figure 2:
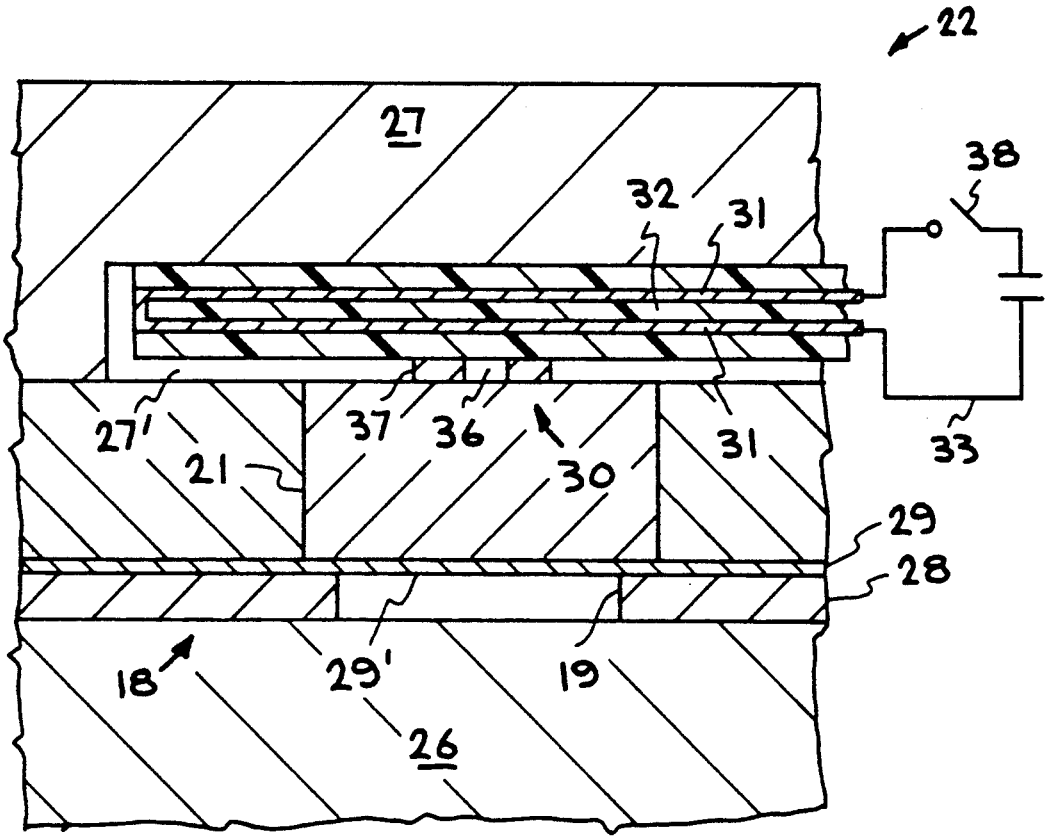
FIG. 2 is an enlarged view of a portion of the insensitive fuse train embodiment of FIG. 1.

The embodiment illustrated in FIG. 1, with a portion thereof enlarged as shown in FIG. 2, comprises a casing 10, only partially shown, to which is secured via bolts or screws 11 an end plate or case 12, and within which is contained a main charge of insensitive explosive material 13, such as PBXW-124, having a cavity, or fuse well 14 therein within which is secured an insensitive fuse train assembly generally indicated at 15 via bolts or screws 16 attached to end plate or case 12 via a clamping flange 17. The main charge 13 PBXW-124, for the case illustrated, is composed of 20% RDX, 27% NTO, 20% Aluminum, 20% Ammonia Perchlorate, and 13% Binder. By way of example the PBXW-124 main charge 13 has a length of 24.00 inches width of 7.250 inches, with the cavity or fuse well 14 therein having a depth of about 4.00 inches and a cross-section of about 4.00 inches. The casing 10, end plate 12, and clamping ring 17 are constructed of steel, with the casing 10 and end plate 12 having a 0.750 inch thickness.

The insensitive fuse train assembly 15 basically comprises an electrical slapper assembly, an initiating explosive pellet, a secondary slapper assembly, a booster charge such as UF-TATB, and an output charge such as LX-17. As shown in FIG. 1, a detonator plate assembly generally indicated at 18 has a central opening 19 therein, with plate 18 being retained by a flange 20 of clamping ring 17. An explosive material 21 (initiating explosive pellet of assembly 15) such as HNS-IV or PETN is retained adjacent to opening 19 of detonator plate assembly 18 via a slapper detonator assembly 22 secured to detonator plate 18 via bolts or screws 23. See FIG. 2 for details of the material 21 and assembly 22. An explosive material or charge 24 of LX-17 is located in cavity or fuse well 14 and is provided with a cavity or well 25 within which is located a booster material or charge 26 of insensitive UF-TATB having a 2.0 inch cross-section and a 2.0 inch length. The components 18–22 are illustrated in detail in FIG. 2. By way of example, the charge 24 has a cross-section of about 4 inches by 4 inches and fits snugly in cavity or fuse well 14, while the cavity or well 25 in charge 24 has a depth of 2.019 inches and a cross-section of 2.016 inches, and booster charge 26 is constructed to fit snugly therein. The LX-17 charge 24 is composed of 92.5% 1,3,5-triamino-2, 4,6-trinitrobenzene plus 7.5% Kel-F800 (a plastic bonding material) composed of Chlorotrifluoroethylene/vinylidine fluoride copolymer, 3:1. The explosive 21 and detonator 22 may be constructed as shown in FIG. 2 or replaced by an RP-95 detonator manufactured by Reynolds Industries Systems Incorporated which comprises an exploding foil initiator (EFI) containing 95% HNS (Hexanitrostilbene) plus 5% Kel-F plastic bonding material with a total explosive weight of 370 mgm. The UF-TATB booster charge 26 is composed of ultra-fine (UF) triamino-trinitrobenzene (TATB). The explosive composition or pellet 21 of detonator 22 may also be PETN composed of 2,2-Bis [nitrooxy) methyl]-1,3-propane-diol, dinitrate (Pentaerythritol tetranitrate) or HNS-IV composed $1,1^3$-(1,2-ethenediyl) bis-2(2,4,6-trinitiobenzene) and Hexanitrostilbene (HNS), which is less sensitive than PETN. HNS-IV and HNS are the same material chemically, but differ in particle size, with HNS-IV composed of finer particles.

Referring now to FIG. 2, which is an enlarged section of the central section of the fuse train 15 of FIG. 1, the detonator plate assembly 18, the explosive material 21, and the slapper detonator assembly 22 are illustrated in detail. The detonator plate assembly 18 comprises a first (thick) plate 28 and a second (thin) plate or member 29 constituting a slapper plate. The opening 19 located in plate 28 constitutes a slapper barrel having a diameter of 0.25 inch and a length of 0.040 inch (thickness of plate 28), with plate 28 being constructed of steel. The slapper plate 29 may be constructed of stainless steel with a thickness of 0.008 inch or of 0.010 inch thick aluminum. The components 28 and 29 of detonator plate assembly 18 constitutes the secondary slapper assembly referred to above.

Figure 3:
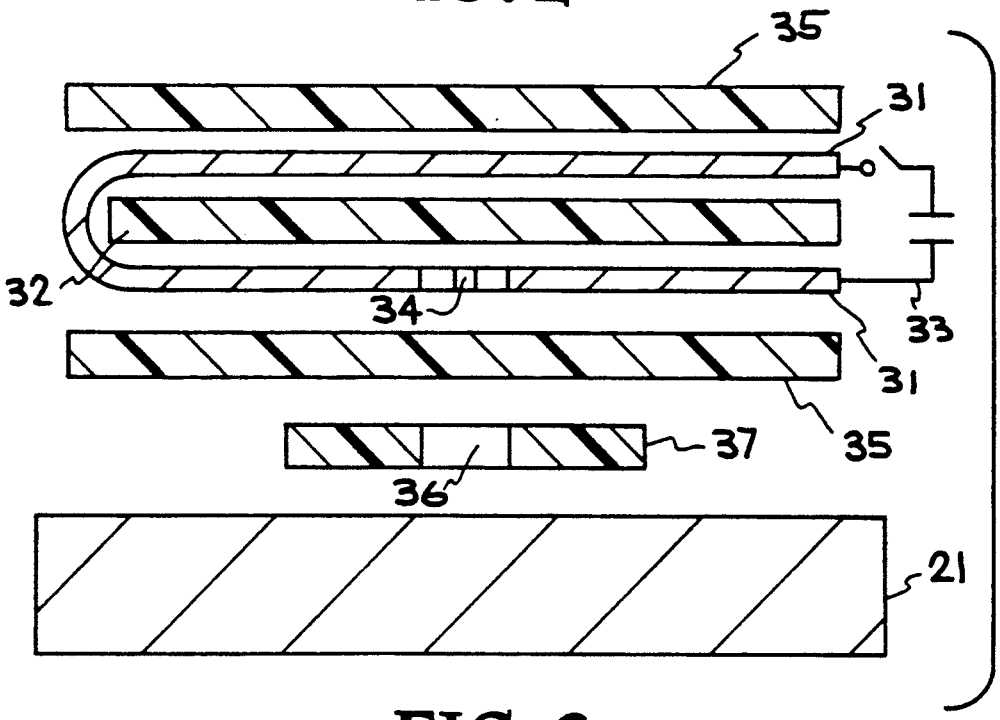
FIG. 3 is an exploded view of the electric slapper assembly of FIG. 2.

The detonator assembly 22 illustrated in FIG. 2 consists of the explosive material or pellet 21 and an exploding foil initiator (EFI) 30 located within a housing 27 which is secured by bolts 23 to detonator plate assembly 18. The EFI 30, shown in exploded view in FIG. 3, comprises a slapper foil assembly based on the above-referenced J. R. Stroud slapper detonator, and may consist of an exploding bridge foil laminate such as a Mound Blue Light Special fabricated by EG&G Mound Laboratories, Ohio. The EFI 30 as shown in FIG. 2 is located within a slot or opening 27' in housing 27 and consists of a foil 31 which extends across opposite sides of an insulator 32 and is connected to a power source 33. The foil 31 includes a bridge section 34, see FIG. 3, and is covered by a layer 35 of insulation material such as Kapton, a thin film polyamide made by Dupont. The Kapton layer 35 directly above the bridge section 34 in foil 31 becomes a flyer or slapper when the bridge section explodes from heating via the electric current from the power supply 33 driving the slapper through an opening or barrel 36 of a member 37 located between EFI 30 and explosive 21, against the explosive 21 when the EFI 30 is activated. The barrel 36 has a diameter of 0.015 inch and length of 0.015 inch. The power supply 33 includes a switch 38 for activating the EFI-30. By way of example, the foil 31 may be 1 inch wide and 175$\mu$ inch thick, and tapered down to bridge section 34 so as to have a length and width of 0.015 inch. The section of foil 31 in which bridge section 34 is located may have a tapered configuration similar to that shown in FIG. 2 of the above reference J. R. Stroud document, or the taper can be straight from the outer edge of foil 31 to bridge section 34.

In operation, closure of the power supply switch 38 causes electric current to flow through foil 31 thereby rapidly heating and exploding the bridge section 34 and causing a slapper, cut from layer 35, to be driven through barrel 36 against the sub-gram explosive material 21 causing ignition. This small explosive 21 drives a section 29' of plate 29, referred to as a secondary slapper, down the opening or barrel 19 of plate 28 onto booster charge 26. The booster charge 26 initiates the larger output LX-17 charge 24, which in turn initiates the main charge 13 of insensitive HE, such as PBXW-124.

Tests have been carried out utilizing the Mound Blue Light Special Exploding Foil Initiator (EFI) detonators and the Reynolds Industries RP-95, and these detonators have effectively initiated a fuse train of the type illustrated in the FIG. 1 embodiment. These tests also verified that the small amount of the initiating explosive 21 was too small to detonate from a thermal stimulus and thus deliberate functioning of the slapper was essential for detonation. Also, the tests established that the secondary slapper assembly will not produce detonation in the booster material 26 unless the initiating pellet 21 is detonated deliberately, and that the booster charge 26 and output charge 24 did not detonate in abnormal thermal environments. In the test embodiment illustrated in FIG. 1 the weight of the LX-17 (explosive 24) was 1357 grams. The weight of the UF-TATB (explosive 26) was 189 grams, and the weight of HNS-IV (explosive 21 in detonator 22) was 0.370 gram, with a total explosive weight of the fuze train being 1546.37 grams.

It has thus been shown that the insensitive fuze train of the present invention provides a means for detonating an insensitive high explosive without compromising the insensitivity of the main high explosive charge. While the illustrated and/or described embodiments, materials, compositions, sizes, weights, etc., have been utilized to set forth the insensitive fuze train of this invention, such description and/or illustrations are not intended to limit the scope of the invention. The scope of the invention is limited only by the appended claims.

We claim:

1. An insensitive fuze train for detonating an insensitive high explosive, comprising:

a detonator including an exploding foil initiator and a sub-gram quantity of a sensitive explosive positioned adjacent said exploding foil initiator;

a slapper plate assembly positioned adjacent said sensitive explosive;

a first insensitive explosive positioned adjacent said slapper plate assembly; and a second insensitive explosive larger than said first insensitive explosive positioned adjacent said first insensitive explosive.

2. The fuze train of claim 1, wherein said sub-gram quantity of sensitive explosive is selected from the group consisting of HNS-IV, PETN, and HNS+Kel-F.

3. The fuze train of claim 1, wherein said exploding foil initiator includes a bridge foil, which upon rapid electrical heating thereof drives a section of said bridge foil against said sub-gram quantity of sensitive explosive for igniting same;

whereby ignition of said explosive of said detonator drives a section of a slapper section of said slapper plate assembly against said first insensitive explosive causing ignition thereof which in turn ignites said second insensitive explosive, the ignition of said second insensitive explosive being adapted to detonate an associated insensitive high explosive.

4. An insensitive fuze train for detonating an insensitive high explosive, comprising:

a detonator comprising a first slapper plate detonator assembly, said first detonator assembly comprising an explosive charge of a subgram quantity of a sensitive explosive and a slapper assembly for detonating said explosive charge;

a second slapper plate detonator assembly positioned adjacent said explosive charge;

a first insensitive explosive positioned adjacent said second slapper plate assembly; and a second insensitive explosive larger than said first insensitive explosive positioned adjacent said first insensitive explosive.

5. The fuze train of claim 4, wherein said explosive charge is selected from the group consisting of HNS-IV and PETN.

6. The fuze train of claim 4, wherein said slapper assembly of said first detonator assembly comprises:

a insulative member;

a foil mounted on said insulative member and extending across opposite surfaces of said insulative member, said foil including a thin bridge section;

an insulator covering said foil;

a barrel forming means positioned adjacent said insulator; and electrical means for rapidly heating said bridge section;

whereby rapid heating of said bridge section causes same to explode driving a section of said insulator through said barrel and against said explosive charge causing ignition of said explosive charge.

7. The fuze train of claim 6, wherein said insulator covering said foil includes a section defining a slapper member, such that activation of said foil drives said slapper member from said insulator, through said barrel, and against said explosive charge.

8. An insensitive fuze train for detonating an insensitive high explosive, comprising:

a detonator comprising a subgram explosive charge and means for igniting said subgram explosive charge, said subgram explosive charge being selected from the group consisting of HNS-IV, PETN, and HNS+Kel-F;

a slapper plate assembly including a first metal plate defining a barrel therein and a second plate;

a first insensitive explosive composed of UF-TATB; and a second insensitive explosive larger than said first insensitive explosive composed of LX-17;

whereby activation of said means of igniting said subgram explosive charge causes ignition of said subgram explosive charge which drives a slapper member from said second plate through said barrel onto said first insensitive explosive causing detonation thereof which in turn causes detonation of said second insensitive explosive.

9. The fuze train of claim 8, in combination with a quantity of an insensitive high explosive, whereby detonation of said second explosive cause detonation of said high explosive.

10. The combination of claim 9, wherein the insensitive high explosive is selected from the group consisting of LX-17 and PBXW-124.

11. An insensitive fuze train comprising:

an exploding foil detonator;

a sub-gram quantity of a sensitive explosive material positioned adjacent to said exploding foil detonator;

a slapper plate assembly positioned adjacent to said sensitive explosive material;

a quantity of a first insensitive explosive material positioned adjacent to said slapper plate assembly; and a quantity of a second insensitive explosive material larger than the quantity of said first insensitive explosive material positioned adjacent to said first insensitive explosive material;

whereby activation of said exploding foil detonator initiates a series of detonations resulting in the detonation of said second insensitive explosive material.

12. The insensitive fuze train of claim 11, wherein said first insensitive explosive material is located at least partially within said second insensitive explosive material.

13. The insensitive fuze train of claim 11, wherein said exploding foil detonator is of a slapper foil type.

14. The insensitive fuze train of claim 13, wherein said sub-gram quantity of an insensitive explosive material is selected from the group consisting of HNS-IV, PETN, and HNS+Kel-F.

15. The insensitive fuze train of claim 11, wherein said slapper plate assemby comprises a first plate having an opening therein defining a barrel, and a second plate positioned adjacent to said first plate and having a thickness substantially less than a thickness of said first plate.

16. The insensitive fuze train of claim 11, wherein said first insensitive explosive material consists of a quantity of UF-TATB, and said second insensitive explosive material consists of a quantity of LX-17.

17. The insensitive fuze train of claim 11, in combination with a quantity of insensitive high explosive material selected from the group consisting of LX-17 and PBXW-124.

* * * * *